United States Patent [19]

Wagatsuma et al.

[11] Patent Number: 5,054,985

[45] Date of Patent: Oct. 8, 1991

[54] METHOD FOR MOUNTING WALL CONSTITUENT MEMBERS AND A GUIDE JIG TO BE USED IN THE SAME METHOD

[75] Inventors: Michio Wagatsuma; Yukio Sado, both of Toyama, Japan

[73] Assignee: Yoshida Kogyo K.K., Tokyo, Japan

[21] Appl. No.: 403,478

[22] Filed: Sep. 6, 1989

[30] Foreign Application Priority Data

Sep. 7, 1988 [JP] Japan ..... 63-222276

[51] Int. Cl.[5] ..... E04G 21/16

[52] U.S. Cl. ..... 414/11; 187/95; 414/786; 414/589; 52/745; 52/749; 52/126.3

[58] Field of Search ..... 187/2, 95; 52/122.1, 52/126.3, 235, 745, 747, 749; 212/166; 414/10, 11, 12, 589, 591, 786

[56] References Cited

U.S. PATENT DOCUMENTS

| | | | |
|---|---|---|---|
| 3,043,401 | 7/1962 | Hallene et al. | 187/95 X |
| 3,087,583 | 4/1963 | Bruns | 187/95 |
| 3,329,240 | 7/1967 | Harwood et al. | 187/95 |
| 3,517,774 | 6/1970 | Meyer | 187/95 X |
| 3,791,094 | 2/1974 | Shannon, Jr. | 414/11 |
| 3,878,916 | 4/1975 | White, Jr. | 187/95 X |
| 4,591,308 | 5/1986 | Imai | 52/745 X |
| 4,637,496 | 1/1987 | Atkey et al. | 187/95 |

FOREIGN PATENT DOCUMENTS

| | | | |
|---|---|---|---|
| 2517227 | 7/1976 | Fed. Rep. of Germany . | |
| 269369 | 6/1964 | Netherlands | 187/2 |
| 6809949 | 1/1970 | Netherlands | 52/745 |
| 979299 | 1/1965 | United Kingdom | 52/745 |

*Primary Examiner*—Frank E. Werner
*Assistant Examiner*—James T. Eller, Jr.
*Attorney, Agent, or Firm*—Hill, Van Santen, Steadman & Simpson

[57] ABSTRACT

Wall constituent members of a curtain wall are conveniently mounted to a building body by making use of vertical guide sections formed on the respective wall constituent members. A wall constituent member having a vertical guide section formed thereon continuously in the vertical direction, is mounted to a lower portion of the building body. A guide jig that is movable along the vertical guide section of the already mounted wall constituent member is detachably connected to upper and lower portions of a new wall constituent member to be additionally mounted. The new wall constituent member is moved up to a predetermined position while raising the guide jig along the vertical guide section of the already mounted wall constituent member. Then, after the new wall constituent member has been mounted to the building body, the guide jig is lowered along the vertical guide sections of the new wall constituent member and the already mounted wall constituent members. Thereafter, the above-described respective steps are sequentially repeated, and thereby a plurality of new wall constituent members can be mounted sequentially from the lower portion of the building body towards the upper portion thereof.

4 Claims, 14 Drawing Sheets

METHOD FOR MOUNTING WALL CONSTITUENT MEMBERS AND A GUIDE JIG TO BE USED IN THE SAME METHOD

BACKGROUND OF THE INVENTION

1. Field of the Invention

The present invention relates to a method for mounting wall constituent members such as panel units, window units, mullions or the like forming a curtain wall used as an outer wall of a building, to a building body, and a guide jig to be used in the same method.

2. Description of the Prior Art

A curtain wall is an outer wall of a building formed by mounting wall constituent members such as panel units, window units, mullion type units and the like to a building body, and with regard to the method for mounting the wall constituent members such as panel units, window units, mullion type units and the like to a building body; various methods have been known.

For instance, the mounting method disclosed in Laid-Open Japanese Patent Specification No. 60-30743 (1985) has been known.

More particularly, the mounting method in which guide rails are formed on the left and right vertical members forming a framework of a panel unit, and panel units to be newly mounted are moved upwards by means of guide jigs which can more vertically along the guide rails of panel units already mounted to a building body and sequentially mounted to the building body, has been known.

In such mounting method, since a pair of left and right guide jigs are respectively fitted to the guide rails formed on the left and right vertical members and then moved vertically, the fitting work of the guide jigs would become troublesome, and so, the mounting work of a panel unit would become troublesome.

SUMMARY OF THE INVENTION

It is one object of the present invention to provide a method for mounting wall constituent members in which the members can be simply moved upwards and can be simply mounted to a building body by means of a single guide jig, and a guide jig to be used in the same method.

In order to achieve the aforementioned object, according to a first feature of the present invention, there is provided a method for mounting wall constituent members of a curtain wall to a building body, consisting of the steps of mounting a wall constituent member having a vertical guide section formed thereon continuously in the vertical direction to a lower portion of the building body, detachably connecting a guide jig that is vertically movable along the vertical guide section of the already mounted wall constituent member to upper and lower portions of a new wall constituent member to be additionally mounted, moving the new wall constituent member up to a predetermined position while raising the above-mentioned guide jig along the vertical guide section of the aforementioned already mounted wall constituent member, lowering the above-mentioned guide jig along the vertical guide section of the new wall constituent member and the vertical guide section of the already mounted wall constituent member after the new wall constituent member has been mounted to the building body, and thereafter sequentially repeating the aforementioned respective steps, whereby a plurality of new wall constituent members can be mounted sequentially from the lower portion of the building body towards the upper portion thereof.

According to the first feature of the invention, since a new wall constituent member can be mounted by raising the new wall constituent member along the vertical guide section of the already mounted wall constituent member and moving it up to a predetermined position by means of a single guide jig, the mounting work of the wall constituent members becomes simple. In addition, since the guide jig is lowered along the vertical guide sections of the new wall constituent member and the already mounted wall constituent member, it can be lowered smoothly.

Furthermore, in order to achieve the aforementioned object, according to a second feature of the present invention, there is provided a method for mounting wall constituent members to a building body, consisting of the steps of forming a guide jig of an upper guide member and a lower guide member, which can vertically move while embracing an outer circumference of a vertical column provided on a front surface of a wall constituent member to serve as a vertical guide section, and a suspending wire connecting the guide members to each other, detachably connecting the upper guide member and the lower guide member of the aforementioned guide jig to the upper and lower portions, respectively, of a new wall constituent member, making the above-mentioned upper and lower guide members rise while embracing the outer circumference of the vertical column of an already mounted wall constituent member to move the new wall constituent member up to a predetermined position of the building body, mounting the new wall constituent member to the building body, making the upper and lower guide members lower along the vertical column of the new wall constituent member and the vertical column of the already mounted wall constituent member, and then sequentially repeating the aforementioned respective steps, whereby a plurality of new wall constituent members can be mounted sequentially from the lower portion of the building body towards the upper portion thereof.

According to the second feature of the invention, since the new wall constituent member is moved to a predetermined position by raising and lowering the upper guide member and the lower guide member of the guide jig while embracing the outer circumference of the vertical column, even with a single guide jig, the new wall constituent member can be moved without accompanied by swinging motion, and the mounting work of the new wall constituent member can be carried out simply, and moreover safely.

Moreover, in order to achieve the above-mentioned object, according to a third feature of the present invention, there is provided a method for mounting wall constituent members to a building body, consisting of the steps of mounting a wall constituent member having a vertical guide section to a lower portion of the building body, forming a guide jig provided with a pair of upper guide members at an upper portion of a guide member support rod and a pair of lower guide members at a middle portion of the same guide member support rod so as to be rotatable in horizontal planes and fixedly provided with a lowermost guide member at a lower portion of the aforementioned guide member support rod, connecting the thus formed guide jig to vertical guide sections of the already mounted wall constituent member and a new wall constituent member, respectively, so that one of the upper guide members, one of the lower guide members and the lowermost guide member may freely rise and fall along the vertical guide section of the already mounted wall constituent member, while the other upper guide member and the other lower guide member may freely rise and fall along the vertical guide section of the new wall constituent member, raising the aforementioned guide jig and the new wall constituent member simultaneously until the above-described one upper guide member and one lower guide member are disengaged from the vertical guide section of the already mounted wall constituent member with the guide jig kept supported from the vertical guide section thereof by means of only the lowermost guide member, moving the new wall constituent member to the side of the building body by rotating the pair of upper guide members and the pair of lower guide members about the above-mentioned guide member support rod under the aforementioned condition to mount it to the building body, thereafter lowering the guide jig along the above-mentioned both vertical guide sections, and sequentially repeating the aforementioned respective steps, whereby a plurality of new wall constituent members can be mounted sequentially from the lower portion of the building body towards the upper portion thereof.

According to the third feature of the invention, since the new wall constituent member can be moved up to a predetermined position along the vertical guide section of the already mounted wall constituent member by means of the guide jig, and also since the new wall constituent member is moved to the side of the building body as being rotated by rotating the upper and lower guide members about the guide member support rod under the condition that the guide jig is kept supported with the lowermost guide member fitted around the vertical guide section, the new wall constituent member can be moved to the side of the building body in a simple member, and moreover after positioning, and the mounting work: can be carried out simply.

Still further, according to a fourth feature of the present invention, there is provided a guide jig comprising an upper guide member composed of a support section that is nearly U-shaped in the horizontal cross-section and provided with a plurality of guide rollers and a mount section that is mounted to the support section and adapted to be connected with a wire, a lower guide member composed of a support section that is neary U-shaped in the horizontal cross-section and provided with a plurality of guide rollers and a mount section that is mounted to the support section and provided with a fitting piece which can fit to a lower portion of a new wall constituent member in a vertically slidable manner, and a suspending wire having one end connected to the support section of the above-described upper guide member via a length adjusting mechanism and the other end connected to the mount section of the above-mentioned lower guide member.

According to the fourth feature of the invention, since the upper guide member and the lower guide member are connected via the suspending wire, the suspending wire is connected to the upper guide member via a length adjusting mechanism, and furthermore a fitting piece of the lower guide member fits to a lower portion of the new wall constituent member in a vertically slidable manner, if the length of the suspending wire is made long by means of the length adjusting mechanism, the fitting piece of the lower guide member would slip out from the lower portion of the new wall constituent member due to its own weight, and so, the lower guide member can be disengaged form the lower portion of the new wall constituent member in a simple manner.

In addition, according to a fifth feature of the present invention, there is provided a guide jig comprising a pair of upper guide members provided at an upper portion of a guide member support rod so as to be rotatable in a horizontal plane and provided with guide rollers, a pair of lower guide members provided at a middle portion of the same guide member support rod so as to be rotatable in a horizontal plane and provided with guide rollers, and a lowermost guide member fixedly provided at a lower portion of the same guide member support rod so as to have the same orientation as one of the above-mentioned upper guide members and one of the above-described lower guide members and provided with guide rollers.

According to the fifth feature of the invention, since the pair of upper guide members and the pair of lower guide members can be rotated in horizontal planes about the guide member support rod but the lowermost guide member is fixedly provided, by rotating the upper and lower guide members under the condition that the guide jig is kept supported with its lowermost guide member fitted around the vertical guide section of the already mounted wall constituent member, the new wall constituent member can be moved to the side of the building body while rotating, and so, the new wall constituent member can be positioned and moved to the side of the building body in a simple manner.

The above-mentioned and other objects, feature and advantages of the present invention will become more apparent by reference to the following description of preferred embodiments of the invention taken in conjunction with the accompanying drawings.

BRIEF DESCRIPTION OF THE DRAWINGS:

In the accompanying drawings:

FIG. 1 is a perspective view showing a mounted condition of a guide jig;

FIG. 2 is a plan view of the same;

FIG. 3 is a general front view showing a lifting condition;

FIGS. 4, 5, 6, 7, 8 and 9 are schematic side views showing successive steps of a mounting work for wall constituent members;

FIG. 10 is a perspective view of a guide jig;

FIG. 11 is a vertical cross-section front view of the same;

FIG. 12 is a plan view of the same;

FIGS. 13, 14, 15 and 16 are schematic side views showing successive steps of a mounting work for wall constituent members;

DESCRIPTION OF THE PREFERRED EMBODIMENTS:

In the following, description will be made on a number of preferred embodiments of the present invention in connection to the accompanying drawings. At first, a first preferred embodiment of the invention will be explained with reference to FIGS. 1 to 9.

Figure 2:
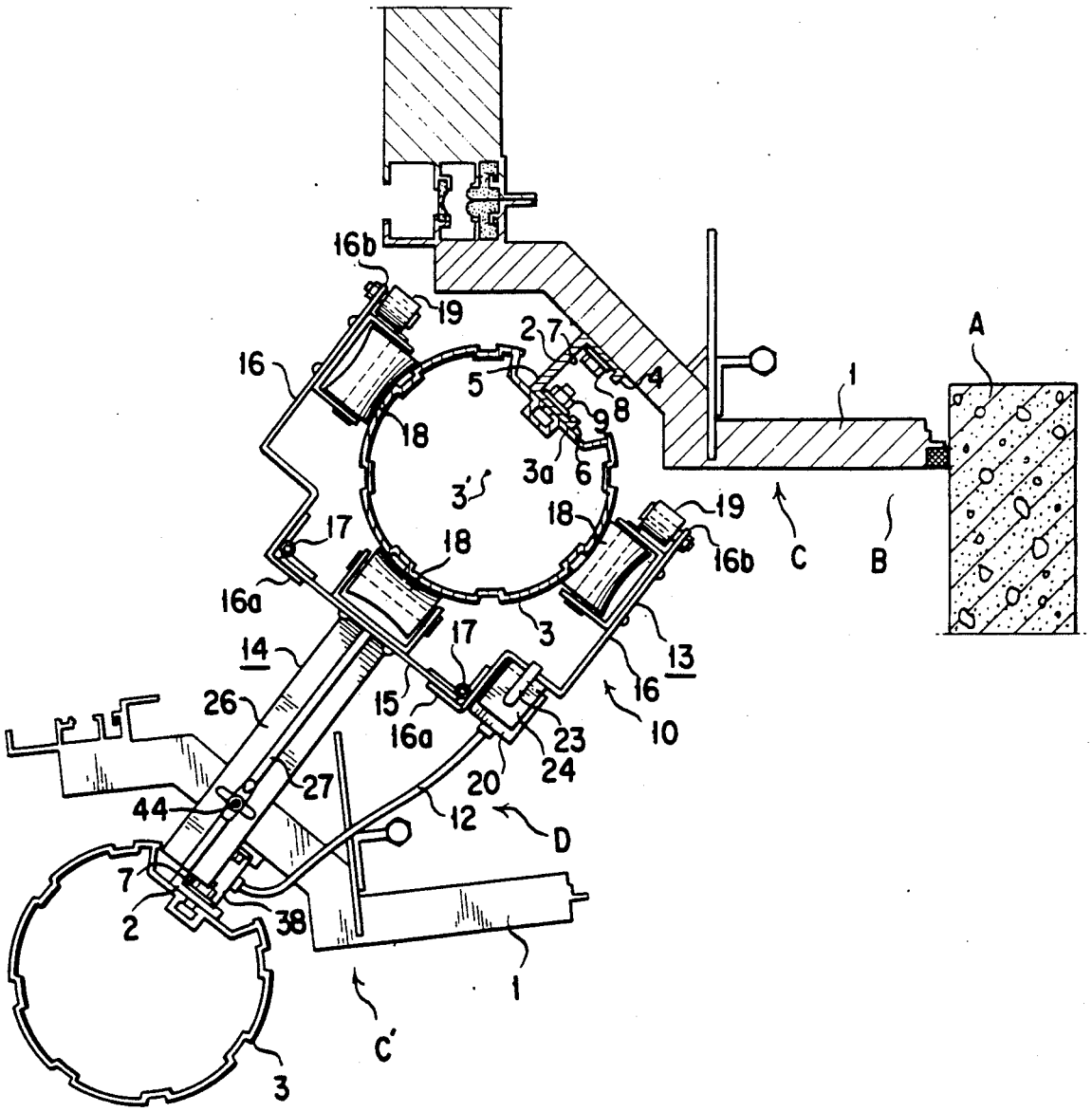

As best seen in FIG. 2, this preferred embodiment concerns a method for mounting panel units C forming one of wall constituent members to a corner portion B of a building body sequentially from the lower portion towards the above, and each panel unit C has an ornamental vertical column serving as a veritcal guide section, for instance, a circular column consisting of a hollow elongated member having a nearby circular cross-section shape, mounted to a front surface of a panel body 1 via a connecting member 2.

The above-mentioned connecting member 2 is an elongated member having a U-shaped transverse cross-section, which consists of one side piece 4, a connecting piece 5 and the other side piece 6 and has a recessed groove 7, the one side piece 4 is fixedly secured to the front surface of the panel body 1 by means of a bolt 8, and the other side piece 6 is fixedly secured to a flat portion 3*a* of the circular column 3 by means of a bolt 9.

Figure 1:
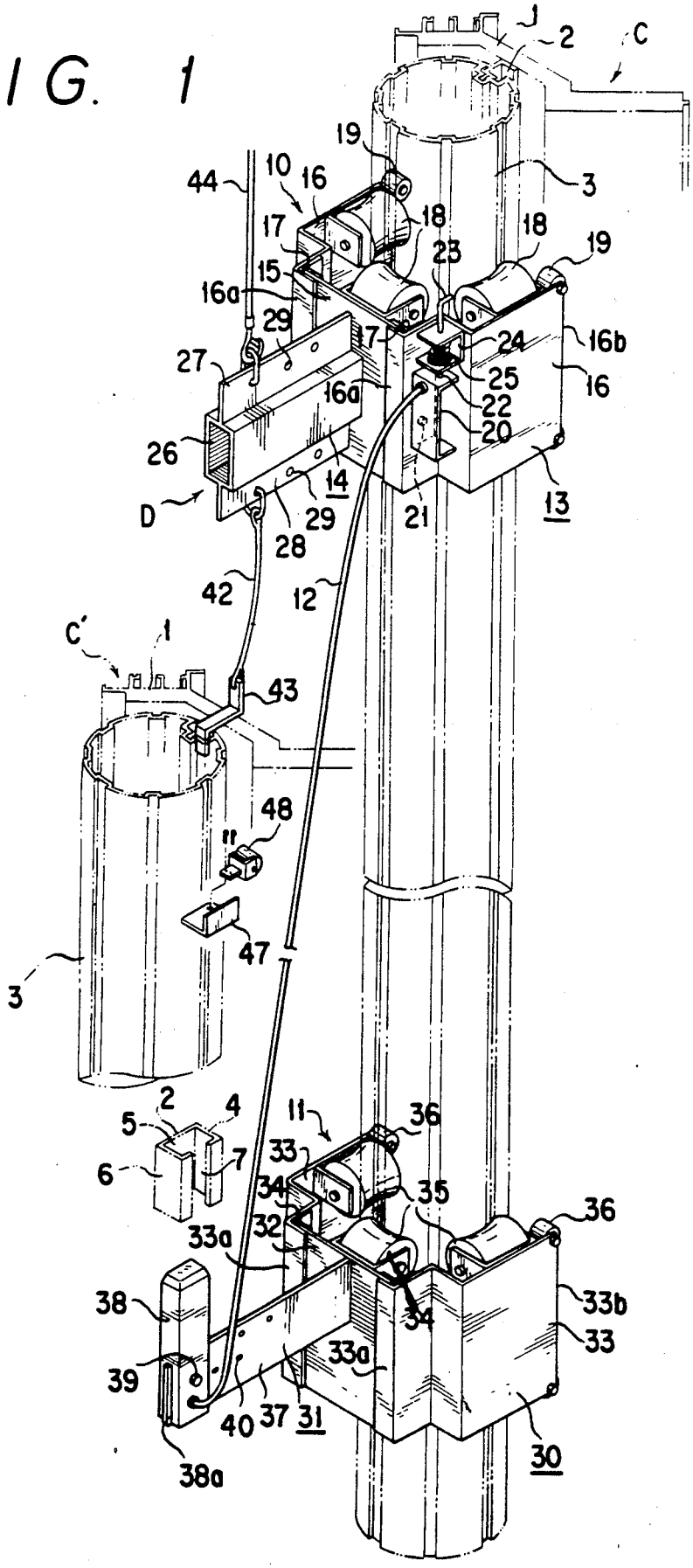
FIGS. 1 through 9 illustrate a first preferred embodiment of the present invention.

As shown in FIGS. 1 and 2, a guide jig D is composed of an upper guide member 10, a lower guide member 11 and a suspending wire 12. The upper guide member 10 is provided with a support section 13 and a mount section 14. The support section 13 is formed in a U-shape as viewed in a plan by swingably mounting a pair of side plates 16 to a base plate 15 via hinges 17, the side plates 16 are biased so as to swing in the directions for closing inwards by means of springs not shown, their end portions are bent to form restraining pieces 16*a*, and these restraining pieces 16*a* restrain swinging motion of the side plates 16 in the direction for opening by butting against the rear surface of the base plate 15. Guide rollers 18 are mounted respectively to the inner surfaces of the base plate 15 and the pair of side plates 16, and the respective guide rollers 18 are formed in an hourglass shape having the same curvature as the outer circumference of the aforementioned circular column 3. In addition, rollers 19 are respectively provided at the tip end portions of the pair of side plates 16, and these rollers 19 project from the tip ends 16*b* of the side plates 16. On one of the side plates 16 is provided a pin 21 as projected horizontally therefrom, and this pin 21 fits to a center hole in a suspending wire mount piece 20, so that the suspending wire mount piece 20 can be mounted in a freely rotatable manner about the pin 21 either in the clockwise direction or in the anti-clockwise direction. One end of the suspending wire 12 is connected to this suspending wire mount piece 20 at a position separated upwards from the pin 21. At the top of the suspending wire mount piece 20 is formed a locking hole 22, and a locking pin 23 that can fit to this locking hole 22 is supported from a U-shaped piece 24 fixedly secured to one of the side plates 16 so as to be vertically movable penetrating through the U-shaped piece 24. This locking pin 23 is biased by a spring 25 so as to fit into the locking hole 22, and thereby the suspending wire mount piece 20 can be held not to freely rotate. A length adjusting mechanism for the suspending wire 12 is composed of the above-described component members. It is to be noted that if desired, the side plates 16 need not be biased so as to swing by means of a spring.

In the above-described mount section 14, upper and lower plates 27 and 28 are provided at the top and at the bottom, respectively, of a rectangular pipe 26 fixedly secured to the rear surface of the base plate 15, and a plurality of through holes 29 are formed in the upper and lower plates 27 and 28 as spaced from each other in the lengthwise direction thereof.

The lower guide member 11 is provided with a support section 30 and a mount section 31. The support section 30 is formed in a U-shape as viewed in a plan by swingably mounting a pair of side plates 33 to a base plate 32 via hinges 33, the side plates 33 are biased so as to swing in the directions for closing by means of springs not shown, their end portions are bent to form restraining pieces 33*a*, and these restraining pieces 33*a* restrain swinging motion of the side plates 33 in the direction for opening by butting against the base plate 32. Guide rollers 35 are provided respectively on the inner surfaces of the base plate 32 and the pair of side plates 33, and the respective guide rollers 35 are formed in an hourglass shape having the same curvature as the outer circumference of the circular column 3. In addition, rollers 36 are respectively provided at the tip end portions of the pair of side plates 33 so as to project from their tip ends 33*b*.

In other words, the support section 30 of the lower guide member 11 has the same configuration as the support section 13 of the upper guide member 10. It is to be noted that if desired, the side plate 33 need not be biased so as to swing by means of a spring.

The above-described mount section 31 includes a horizontal member 37 fixedly secured to a base plate 32 of the support section 30 and having a plurality of through-holes 40 drilled therein as spaced from each other in the lengthwise direction thereof, and a fitting piece 38 having a slit groove 38*a* formed at its bottom so as to slidably fit to the horizontal member 37 from the above, and the fitting piece 38 can be fixedly secured to the horizontal member 37 at a desired position by means of a bolt 39 and a selected one of the through-holes 40. Therefore, the mount position of the fitting piece 38 on the horizontal member 37 is adjustable along the lengthwise direction of the member 37. The other end of the suspending wire 12 is connected to a lower portion of the fitting piece 38.

Figure 3:
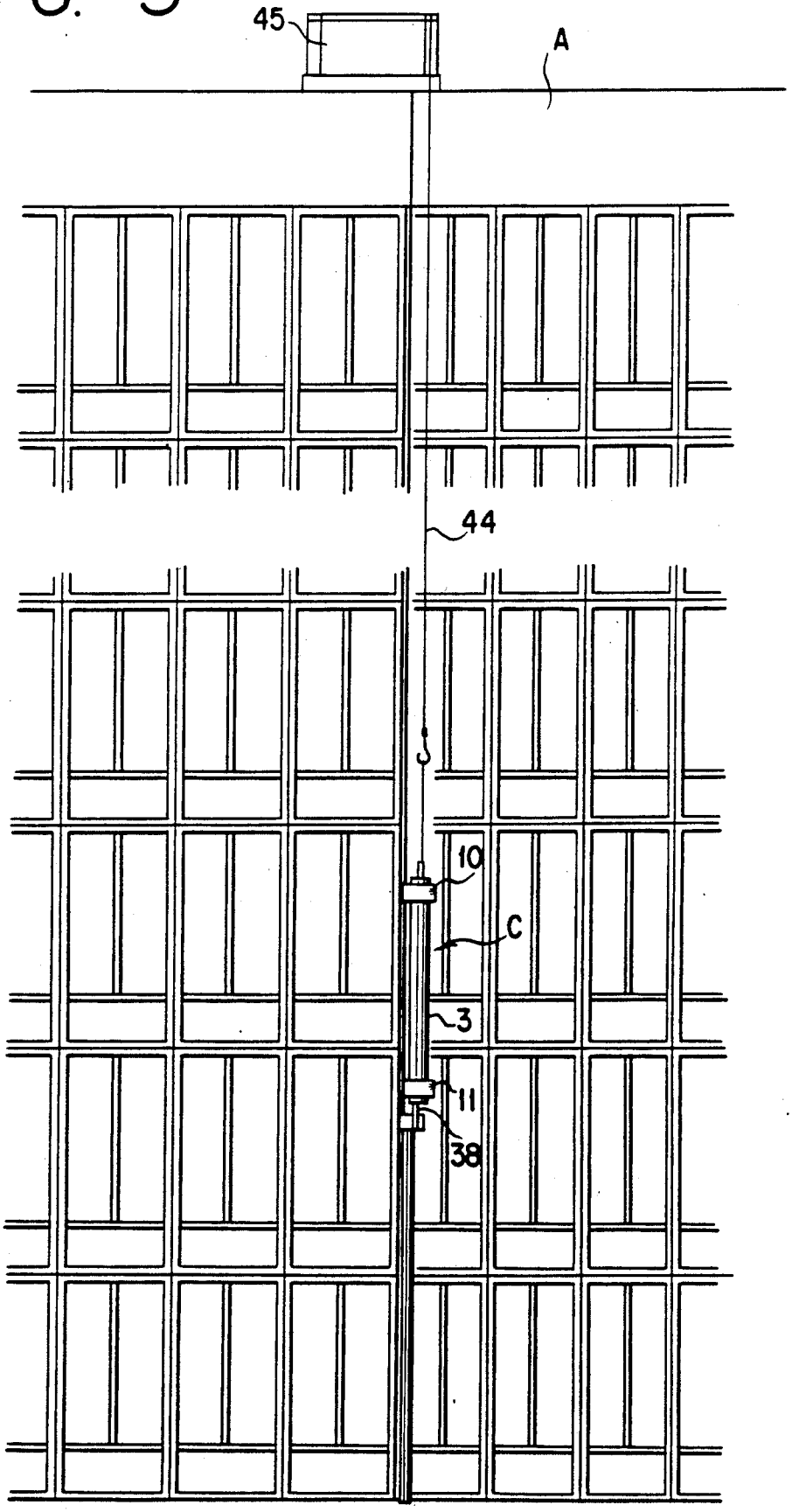

The support sections 13 and 30 of the upper and lower guide members 10 and 11, respectively, are adapted to freely slide in the vertical direction along the circular column 3 of the panel unit C (hereinafter called "already mounted panel unit") which has been mounted to the building body A as shown in FIG. 1 as guided by the guide rollers 18 and 35. The fitting piece 38 of the lower guide member 11 fits into the recessed groove 7 of the connecting member 2 of a new panel unit C' now intended to be mounted additionally (hereinafter called simply "new panel unit") to connect the lower guide member 11 with the lower portion of the new panel unit C'. Then, one end of a wire 42 is connected to the through-hole 29 drilled in the lower plate 28 of the mount section 14 in the upper guide member 10, while the other end of the same wire 42 is connected to an upper portion of the circular column 3 of the new panel unit C' via a suspender metal 43 to connect the upper guide member 10 with the upper portion of the new panel unit C'. Also, a lifting wire 44 is connected to the through-hole 29 drilled in the upper plate 27, and this lifting wire 44 is wound up by a lifting machine 45 installed on the roof of the building body A as shown in FIG. 3. Thereby, the new panel unit C' can be moved upwards along the circular column 3 of the already mounted panel unit C by means of the upper and lower guide members 10 and 11.

At this moment, since the guide rollers 18 and 35 would become to embrace the outer circumference of the circular column 3, the new panel unit C' would not swing and move, and in the event that it should swing and move, as the rollers 19 and 36 would achieve guide actions while butting against the panel body 1, it would never occur that the respective side plates 16 and 33 of the upper and lower guide members 10 and 11 interfare with the panel body 1 and damage the surface of the panel body 1. Moreover, since the guide rollers 18 and 35 provided on the pairs of side plates 16 and 33 are held in tight contact with the outer circumference of the circular column 3 at right angles to the radial directions as opposed to the center axis 3' of the circular column 3, and since the pairs of side plates 16 and 33 are restrained from rotating in the opening directions by the restraining pieces 16*a* and 33*a*, the guide rollers 18 and 35 would be never disengaged from the circular column 3.

The lower guide member 11 and the lower portion of the circular column 3 of the new panel unit are coupled to each other merely by fitting of the fitting piece 38 into the recessed groove 7 of the connecting member 2, and they are relatively displaceable in the vertical direction. Since the lower guide member 11 is suspended from the upper guide member 10 via the suspending wire 12 to be coupled to each other, if the suspending wire mount piece 20 is rotated by 180 degrees about the pivot pin 21, then the connecting position of the upper end of the suspending wire 12 to the suspending wire mount piece 20 is displaced downwards, hence the lower guide member 11 also moves downwards, and the fitting piece 38 slips out from the recessed groove 7, so that the new panel unit C' and the lower guide member 11 are separated from each other.

In addition, since the mount position of the fitting piece 38 to the horizontal member 37 can be adjusted by selected appropriate one of the plurality of through-holes 40, the new panel unit C' can be suspended and supported always under a stable condition by adjusting the mount position depending upon the position of the center of gravity of the new panel unit C'.

Now, the mounting method according to the first preferred embodiment of the present invention making use of the above-described guide jig, will be described with reference to FIGS. 4 to 9.

Figure 4:
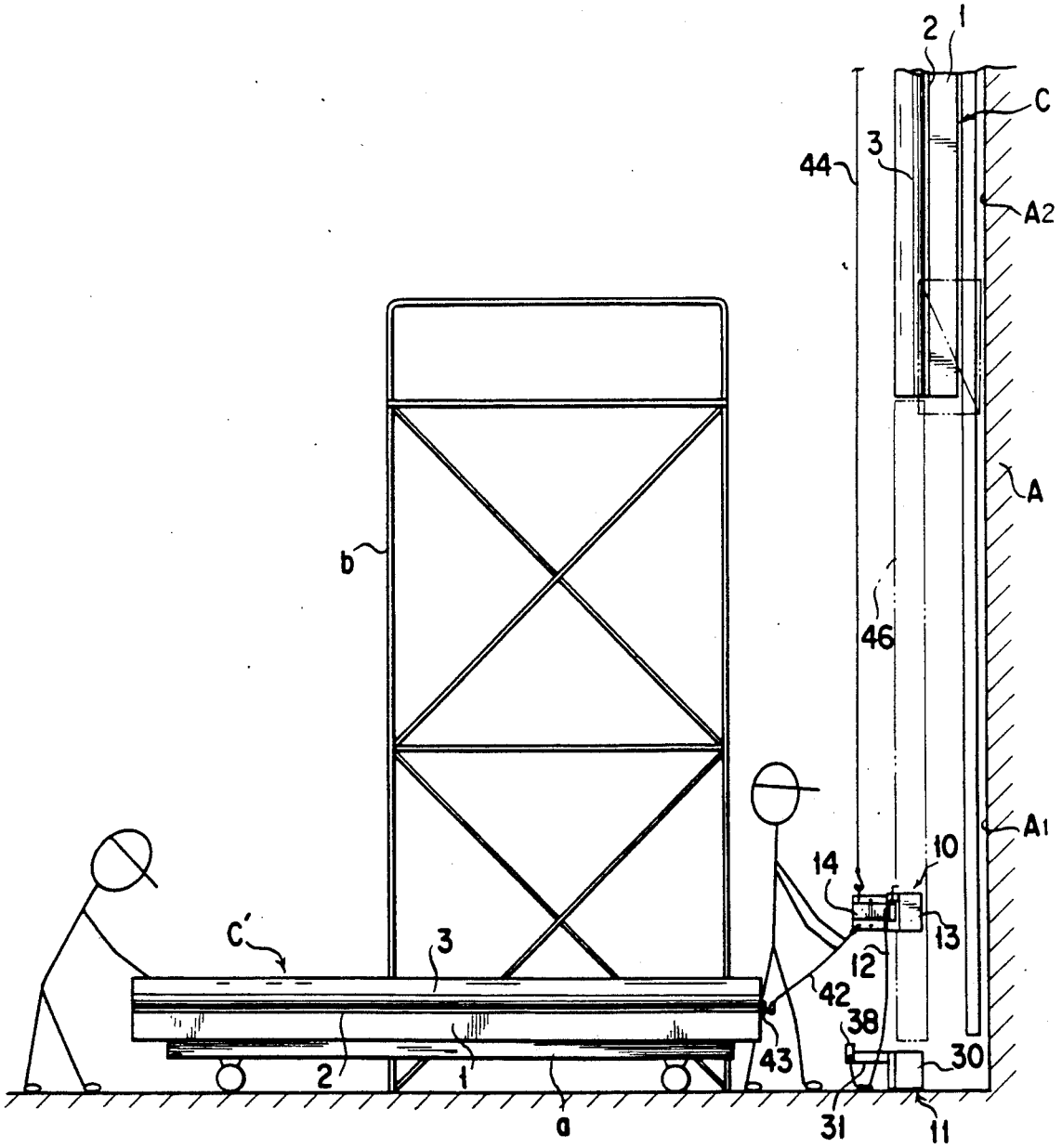

As shown in FIG. 4, at first, a panel unit C is mounted to a second floor portion $A_2$ of a building body A.

This mounting work could be done by directly connecting the panel unit C to a wire 44 and lifting it up by means of a lifting machine 45, or the panel unit C could be mounted by providing a circular column 46 for guide use at a first floor portion $A_1$ and making use of a guide jig D.

Subsequently, as shown in FIG. 4, a wire 44 paid out from a lifting machine 45 (See FIG. 3) is connected to an upper guide member 10, and a wire 42 is connected via a suspender metal 43 to the top of a circular column 3 of a new panel unit C' on a traveling truck a.

Under this condition, the upper guide member 10 is lifted up by winding up the wire 44 by means of the lifting machine 45, and the new panel unit C' is gradually lifted up by the wire 42 to take a vertical attitude. During this period, the traveling truck a is gradually moved towards the building body A to facilitate the new panel unit C' to take a vertical attitude.

Figure 5:
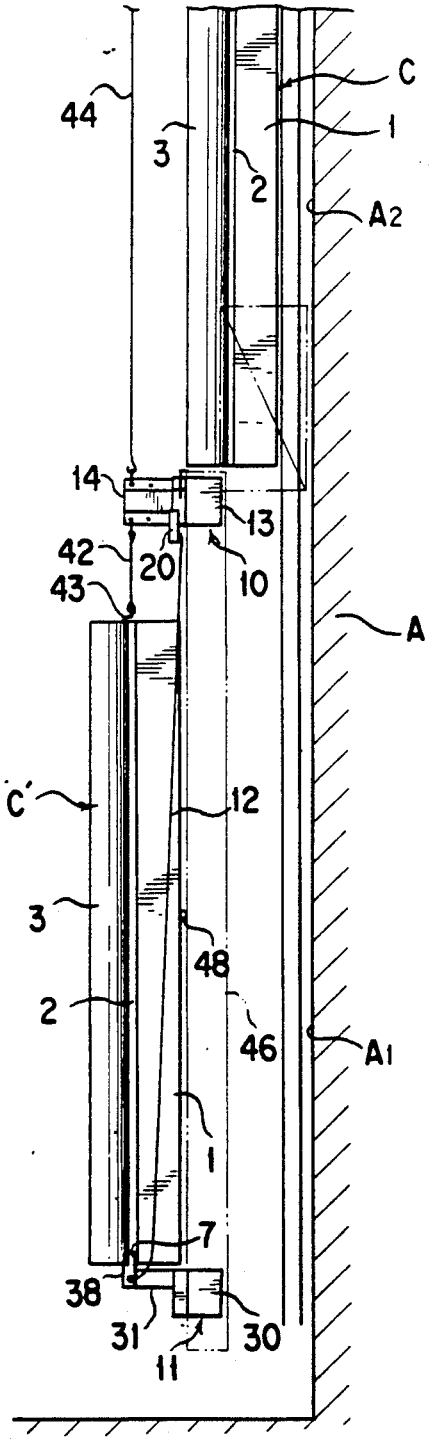

When the new panel unit C' has taken a vertical attitude as shown in FIG. 5, an intermediate auxiliary roller 48 is mounted to its intermediate portion in the vertical direction via an intermediate fastener 47, and also the fitting piece 38 of the lower guide member 11 is fitted into the recessed groove 7 in the connecting member 2 of the lower guide member 11 as shown in FIG. 1.

At this moment, the suspending wire mount piece 20 of the upper gudie member 10 takes a downwardly directed condition after it has been rotated 180 degrees with the locking pin 23 disengaged from the locking hole 22, to elongate the suspending length of the suspending wire 12, that is, to elongate the distance between the lower guide member 11 and the upper guide member 10 so that the fitting piece 38 can be easily fitted into the recessed groove 7, and once the above-mentioned fitting has been finished, the suspending wire mount piece 20 is again rotated by 180 degrees, the locking pin 23 is fitted into the locking hole 22, and thereby the suspending length of the suspending wire 12 is shortened, that is, the distance between the lower guide member 11 and the upper guide member 10 is shortened so that the fitting piece 38 can not slip off the recessed groove 7.

Figure 6:
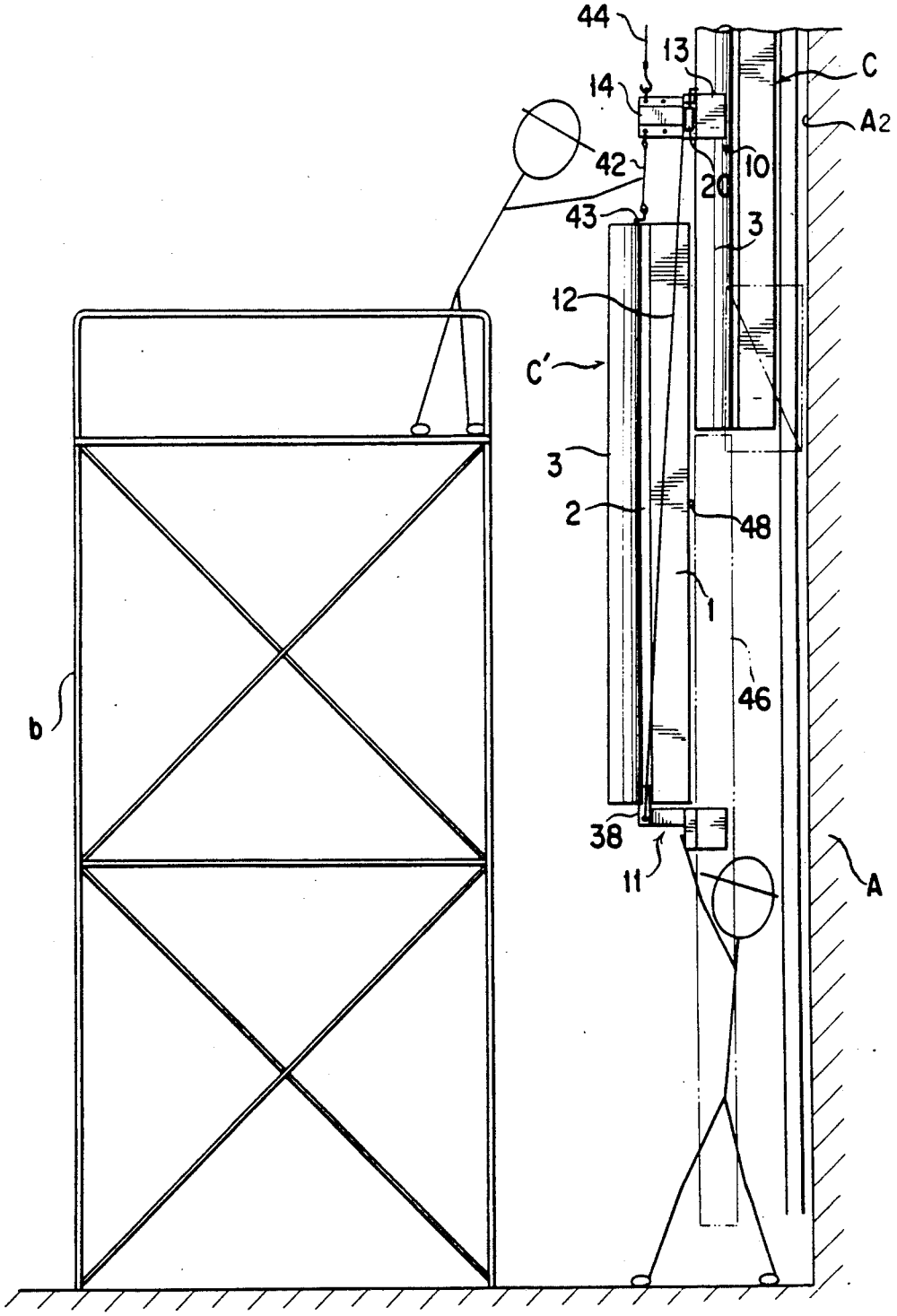

Then, while the new panel unit C' is being raised slowly together with the guide jig D, the support section 13 of the upper guide member 10 is fitted around the bottom portion of the circular column 3 of the already mounted panel unit C, and the guide rollers 18 are brought into tight contact with the outer circumference of the circular column 3 as shown in FIG. 6, and more particularly, as shown in FIG. 2. These works are done by workers standing on a scaffold b.

Furthermore, the wire 44 is wound up to raise the upper guide member 10 along the circular column 3, and the guide rollers 35 in the support section 30 of the lower guide member 11 are made to fit around the lower portion of the circular column 3 as shown in FIG. 1. In this way, the new panel unit C' is guided so as to be raised or lowered along the circular column 3 by means of the upper and lower guide members 10 and 11.

Figure 7:
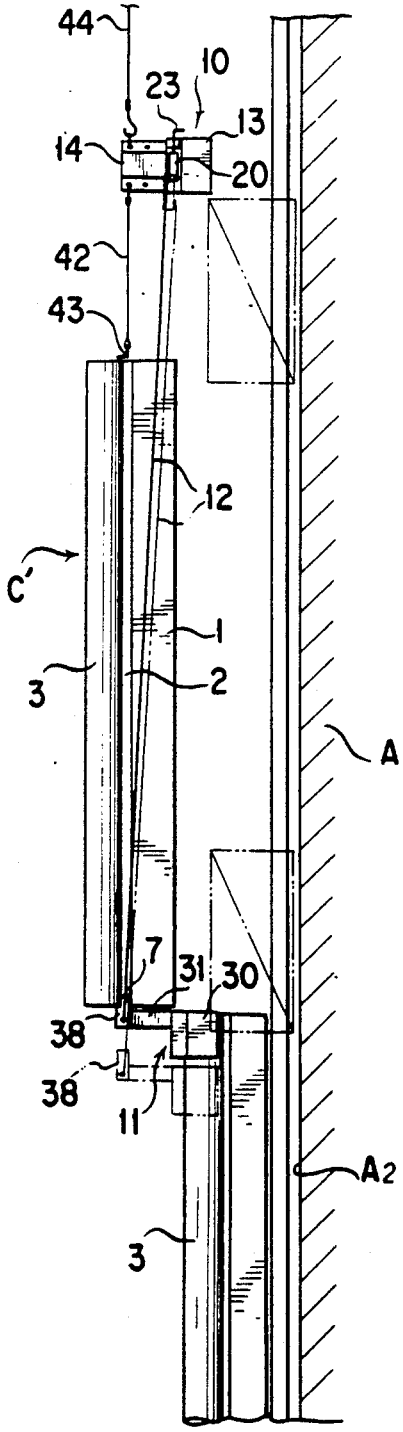

When the new panel unit C' has risen up to a predetermined mount position, as shown in FIG. 7 the upper guide member 10 slips out from the circular column 3, and the lower guide member 11 would be positioned at the upper portion of the circular column 3. Under this condition, the intermediate auxiliary roller 48 is removed, the locking pin 23 in the upper guide member 11 is extracted from the locking hole 22, then the suspending wire mount piece 20 is rotated by 180 degrees to take its downwardly directed condition, thereby the suspending length of the suspending wire 12 is elongated, hence the fitting piece 38 is allowed to slip out from the recessed groove 7 due to the own weight of the lower guide member 11, and the lower guide member 11 is separated from the lower portion of the new panel unit C'. The removed intermediate auxiliary roller 48 is fixedly secure to the lower plate 27 of the upper guide member 10 as by a carabineer or the like.

Figure 8:
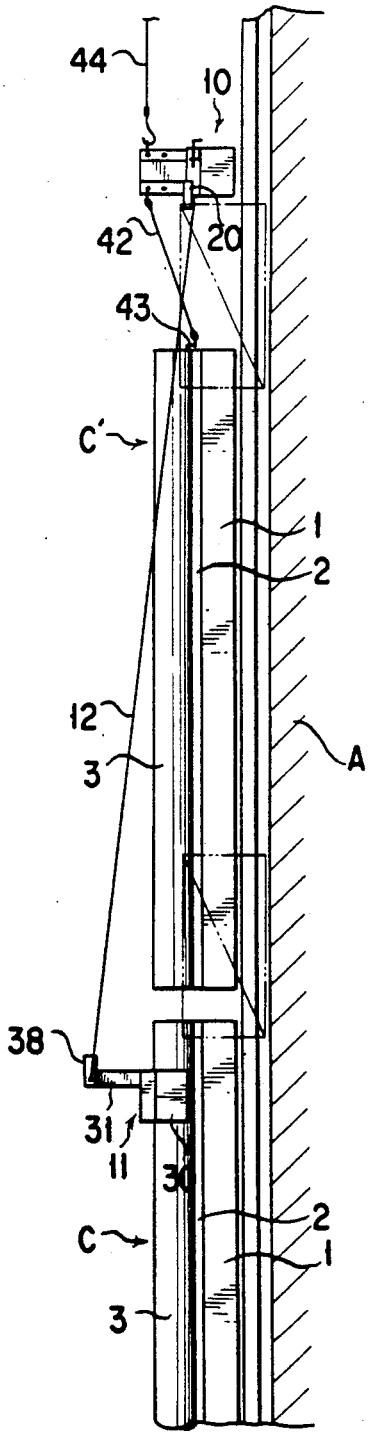

Under the above-mentioned condition, as shown in FIG. 8 the new panel unit C' is attracted to the side of the building body A, set at a predetermined position and temporarily fixed there, and thereafter the suspender metal 43 is removed from the circular column 3, and the suspender metal 43 is fixedly secure to the through-hole 29 (illustrated in FIG. 1) in the lower plate 28 of the upper guide member 10 by means of a carabinner or the like.

Figure 9:
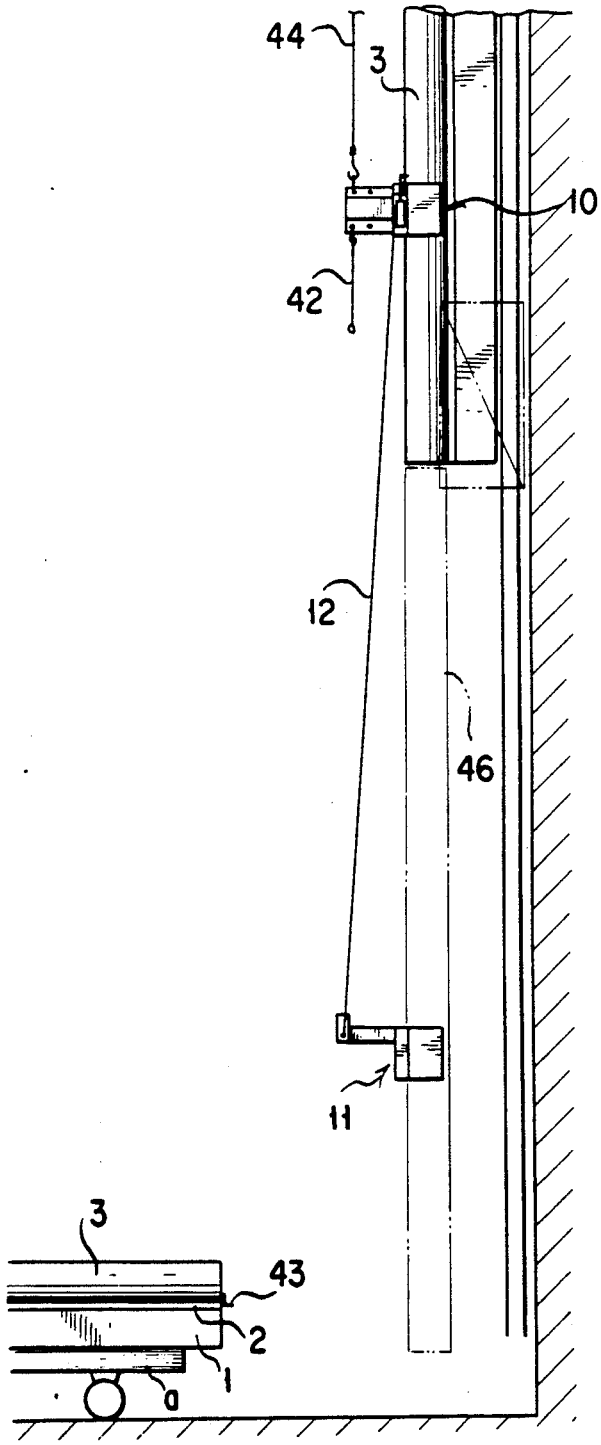

After the new panel unit C' has been mounted to the building body A, the support section 13 of the upper guide member 10 is made to fit about the upper portion of the circular column 3 with its guide rollers 18 held in tight contact with the outer circumference thereof, then as shown in FIG. 9 the wire 44 is paid out to lower the upper and lower guide members 10 and 11 along the circular column 3, and the condition down in FIG. 4 is realized.

By repeating the aforementioned operations, additional new panel units C' are successively mounted.

Now description will be made on a second preferred embodiment of the present invention with reference to FIGS. 10 to 16.

Figure 10:
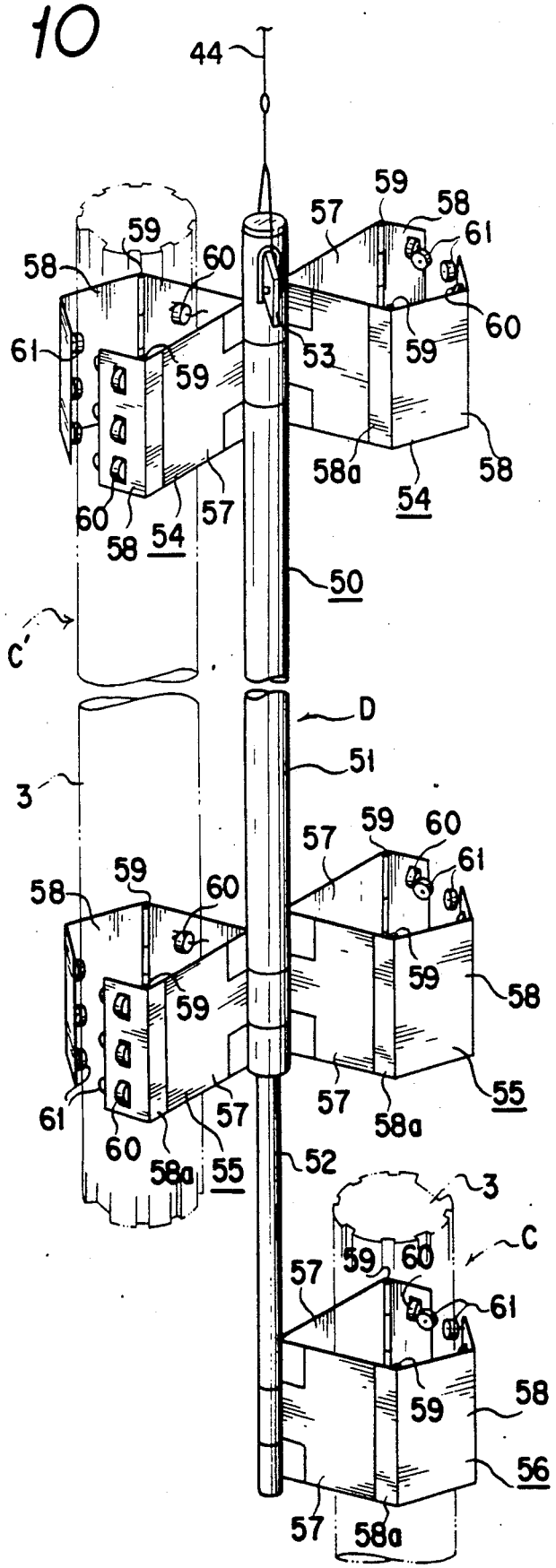
FIGS. 10 through 16 illustrate a second preferred embodiment of the present invention.
Figure 11:
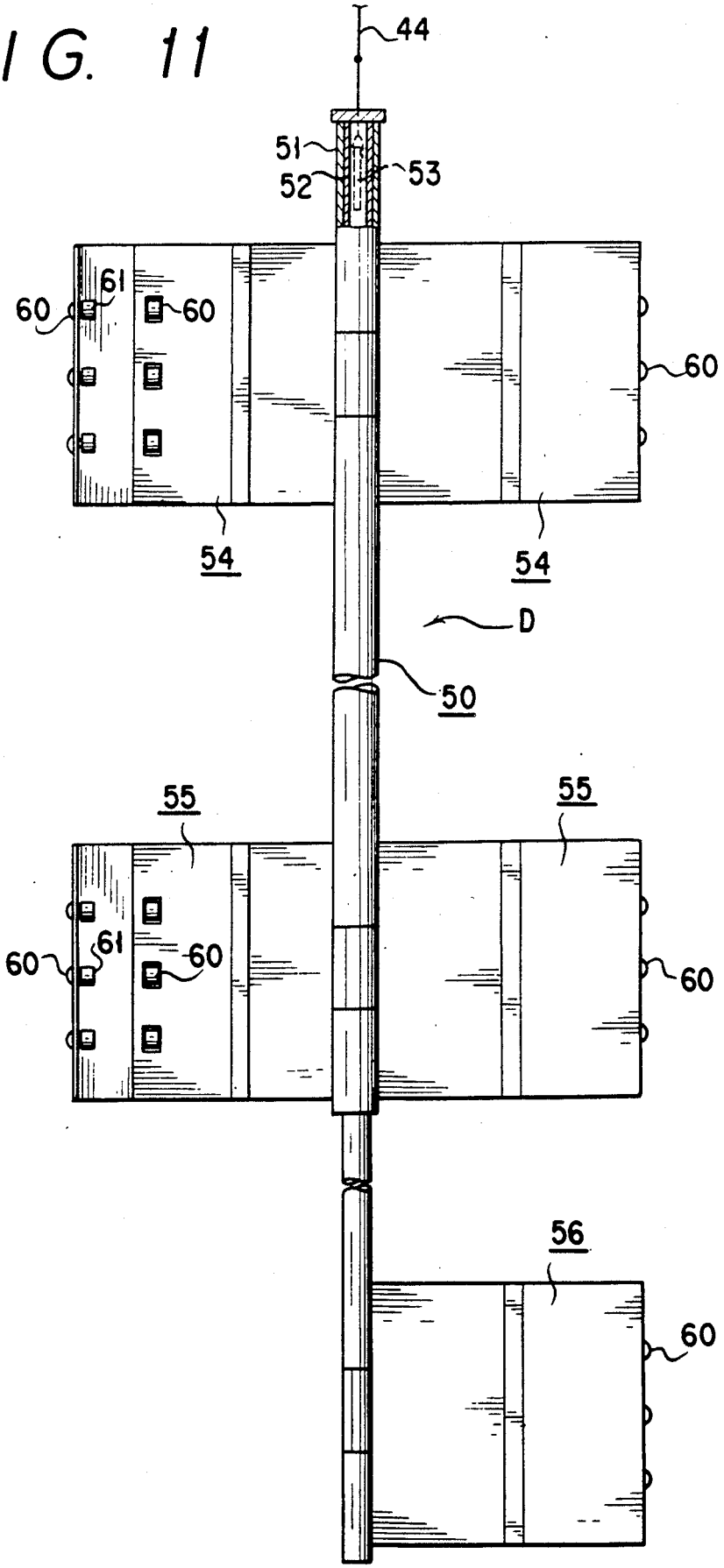
Figure 12:
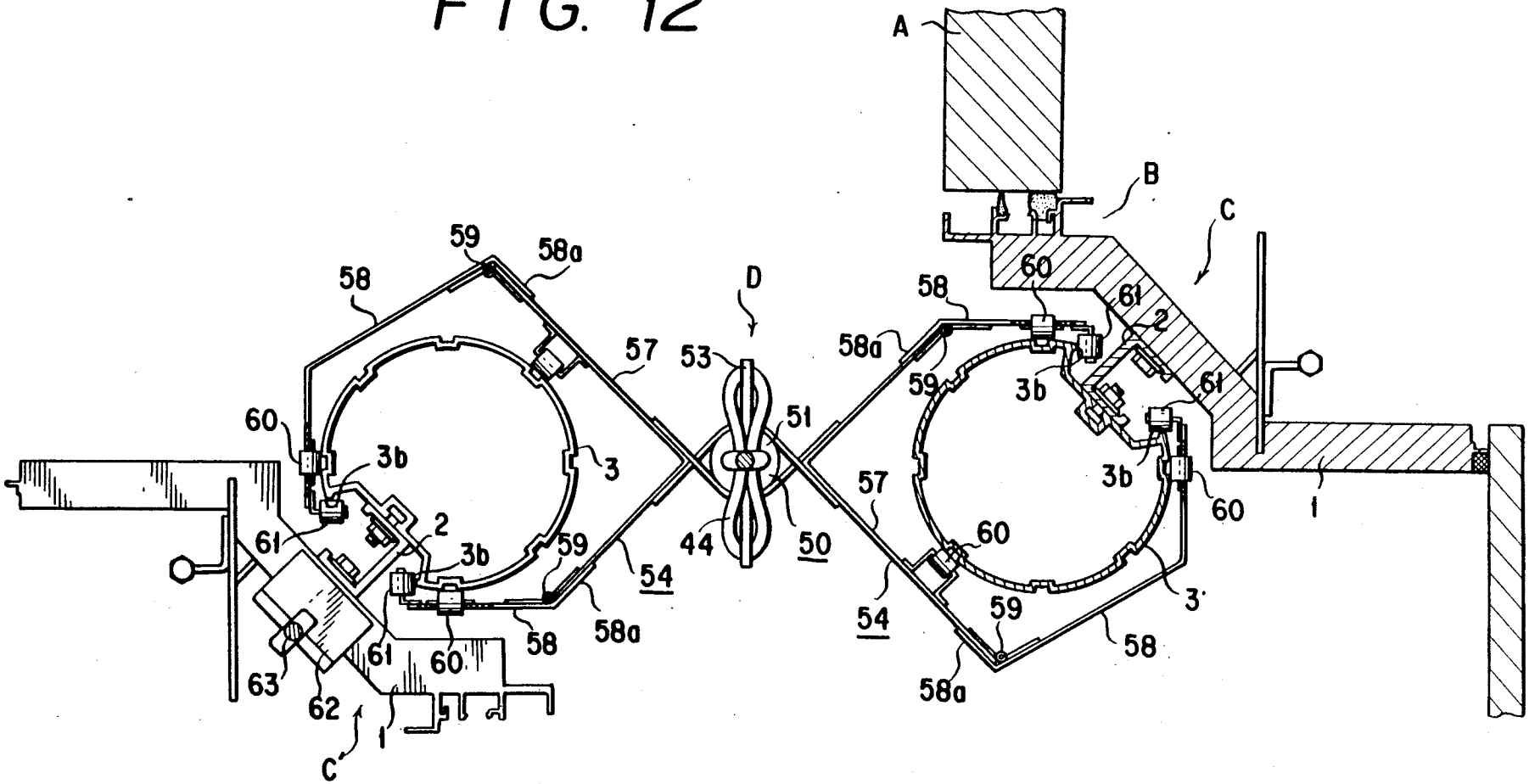

A guide jig D to be used in the second preferred embodiment is constructed as shown in FIGS. 10 to 12. More particularly, a guide jig support rod 50 is formed in such configuration that within a tubular first support rod 51 is rotatably supported a tubular second support rod 52. A mount piece 53 is provided at an upper portion of the first support rod 51, a wire 44 is connected to the mount piece 53 so that the guide member support rod 50 can be moved vertically by the lifting machine 45, a pair of upper guide members 54 are mounted at an upper portion of the first support rod 51 as angularly displaced in a 180 degrees out-of-phase relation, a pair of lower guide members 55 are mounted at a lower portion of the first support rod 51 as angularly displaced in a 180 degrees out-of-phase relation, and a lowermost guide member 56 is mounted at a lower portion of the second support rod projecting downwards from the first support rod 51.

In each of the above-described guide members 54, 55 and 56, a pair of side plates 58 are mounted to the opposite edges of a base plate 57 bent in an L-shape in cross-section via hinges 59 so as to be freely opened and closed as rotationally biased in the closing direction by means of a spring not shown, an end portion of the side plate 58 is bent to form a restraining piece 58*a*, so that rotation of the side plate 58 in the opening direction is restrained by making the restraining piece 58*a* butt against the base plate 57, guide rollers 60 are mounted on the base plate 57 as well as the pair of side plates 58 as angularly spaced from one another by about 120 degrees, anti-slip-out rollers 61 are provided at one end portions of the pair of side plates 58 so as to come into contact with the opposite ends 3*b* of the recessed portion of the circular column 3, thereby the guide members are enabled to move vertically along the circular column 3 with the guide rollers 60 held in contact with the outer circumference of the circular column 3, and also, they are prevented from rotating about the circular column 3, owing to the anti-slip-out rollers 61.

It is to be noted that the guide rollers 60 provided on the side plates 58 protrude outwards from the side plates 58, so that when the guide members have swung and moved laterally, these guide rollers would butt against the panel body 1 and would not damage the panel body 1.

One of the upper guide members 54, one of the lower guide members and the lowermost guide member 56 occupy the same angular position in a horizontal plane and vertically align in one row, they can freely rise and fall along the circular column 3 of the already mounted panel unit C, the other upper and lower guide members 54 and 55 are fitted around the circular column 3 of the new panel unit C' so as to be able to rise and fall freely, the top of the panel body 1 of the new panel unit C' is connected to a wire 63 via a suspender metal 62, this the new panel unit C' and the already mounted panel C are disposed in a 180 degrees out-of-phase relation along a horizontal plane with respect to the center axis of the guide member support rod 50, and this wire 63 is connected to the above-described wire 44 so that the new panel unit C' can be raised jointly with the guide jig D along the circular column 3 of the already mounted panel unit C.

Next, the mounting method according to the second preferred embodiment of the present invention making use of the just described guide jig, will be described with reference to FIGS. 13 to 16.

Figure 13:
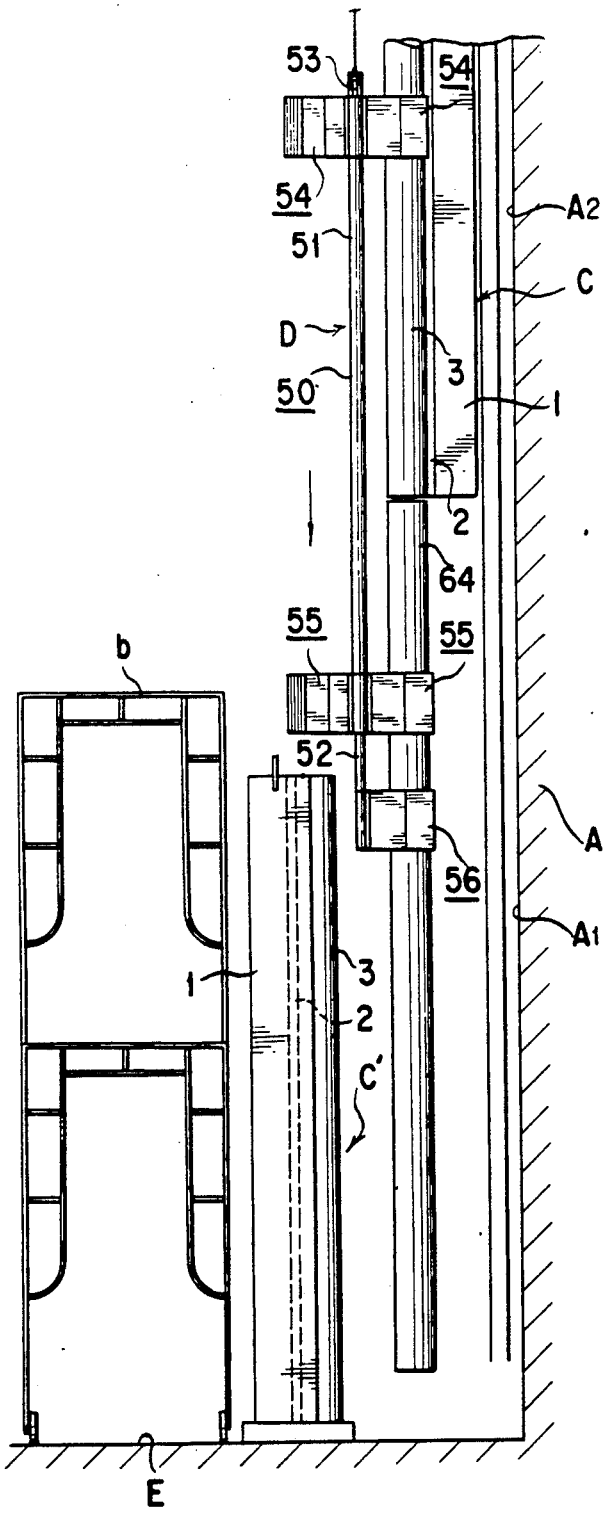

As shown in FIG. 13, an auxiliary circular column 64 is mounted right under the circular column 3 of the already mounted panel unit 3 which was mounted to a second floor portion $A_2$ of a building body A, also, one upper guide member 54, one lower guide member 55 and the lowermost guide member 56 of the guide jig D are engaged with the auxiliary circular column 64 so that they can freely rise and fall along the circular column 64, and a new panel unit C' is erected on the ground surface E by making use of a scaffold b.

Figure 14:
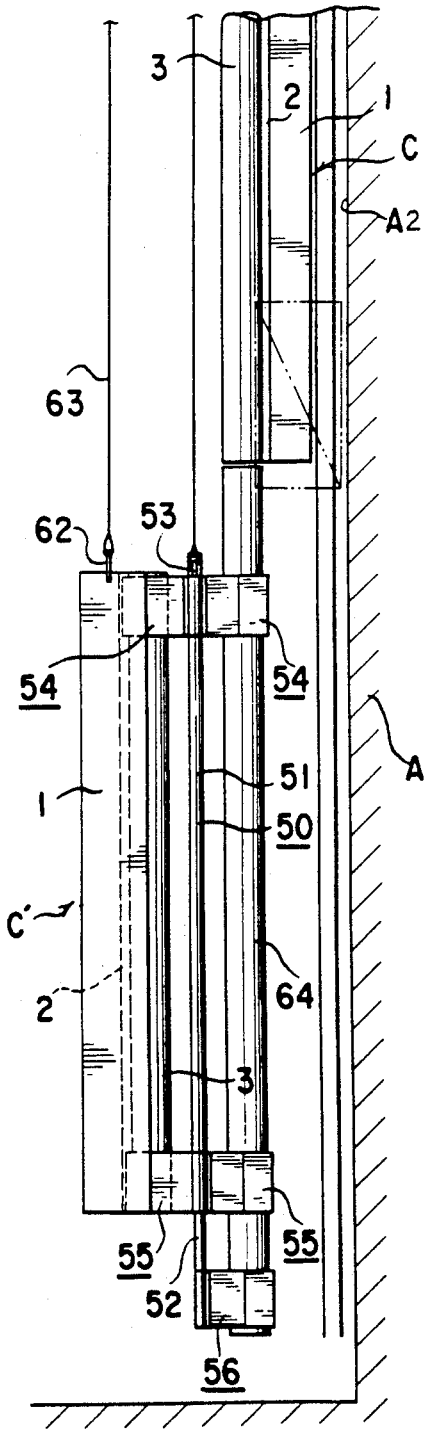

Thereafter, the guide jig D is lowered so that the other upper guide member 54 and the other lower guide member 55 may fit around the circular column 3 of the new panel unit C', a wire 63 is connected to the top of the circular column 3 via a suspender metal 62, and then the new panel unit C' is lifted up jointly with the guide jig D along the auxiliary circular column 64 and the circular column 3 of the already mounted panel unit C by winding up the wires 44 and 63 as shown in FIG. 14.

Figure 15:
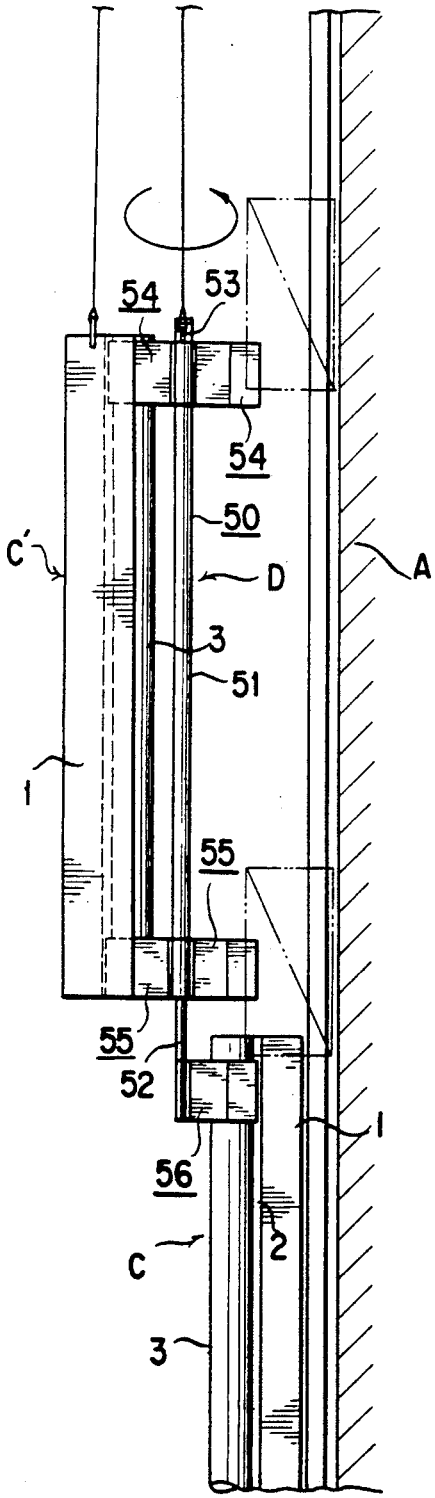
Figure 16:
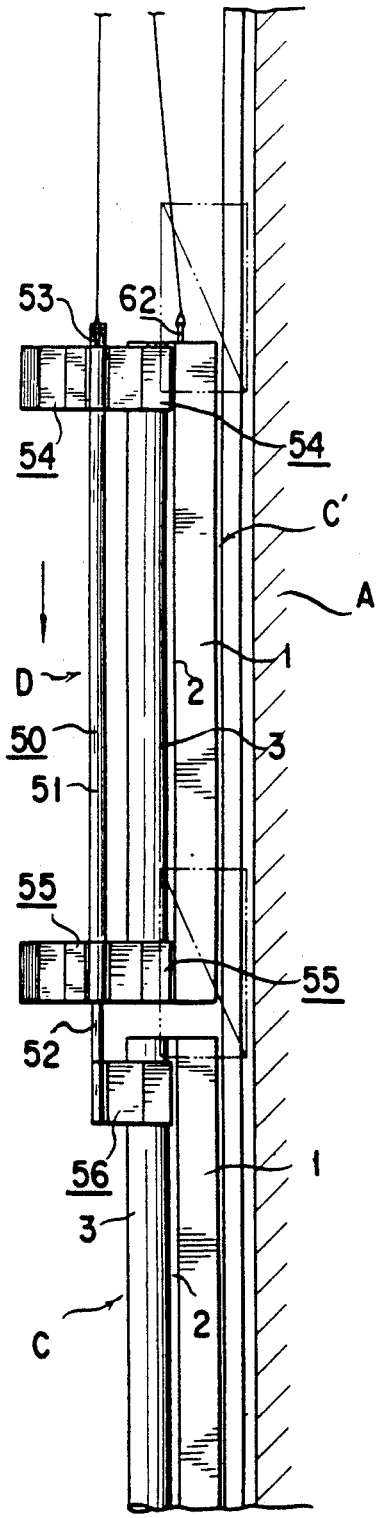
Figure 17:
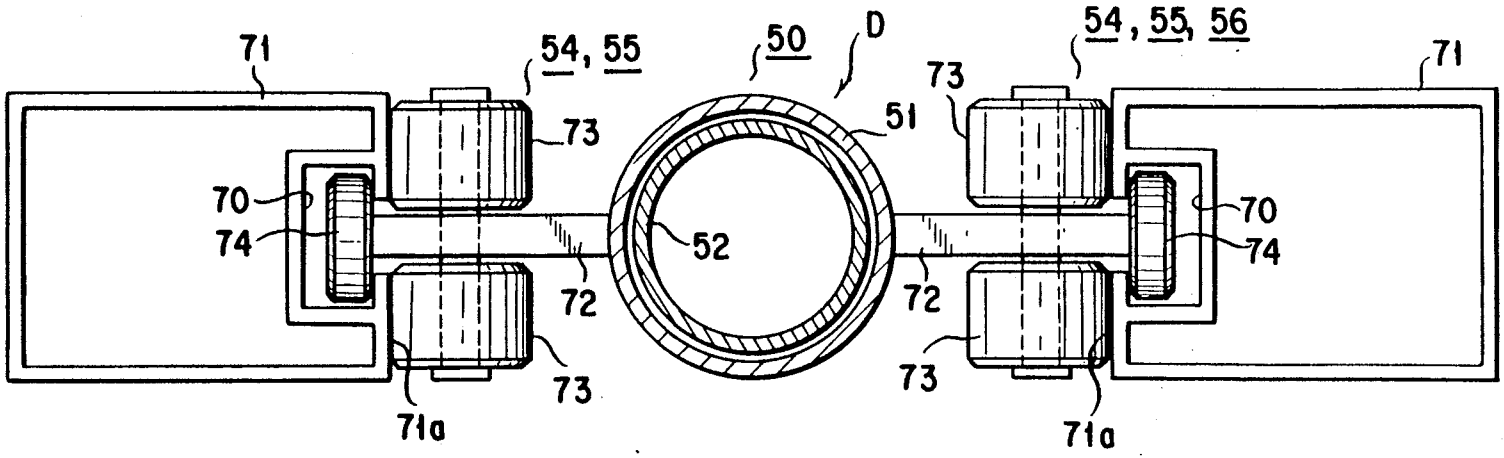
FIG. 17 is a plan view showing a third preferred embodiment of the present invention.

Then, when they have been lifted up to a predetermined position as shown in FIG. 15, the one upper guide member 54 and the one lower guide member 55 are disengaged from the circular column 3, while the lower-most guide member 56 is kept fitted around the upper portion of the circular column 3, and starting from this condition, the first support rod 51 is rotated by 180 degrees in a horizontal plane about the second support rod 52 so that the new panel unit C' is made to approach to the building body A and is set at a predetermined position as shown in FIG. 16. At this time, the lower portion of the second support rod 52 is held by the circular rod 3 via the lowermost guide 56, and so the first support rod 51 can rotate smoothly.

Therefore, the new panel unit C' is temporarily fixed, the suspender metal 62 is disengaged from the panel body 1, and by paying out the wire 44 the guide jig D is lowered along the circular column. At this time, the above mentioned other upper guide member 54 and other lower guide member 55 would fall along the circular column 3 which has been so far supported by these guide members, and since the lowermost guide member 56 is kept fitted around the circular column 3 of the already mounted panel unit C, the above-mentioned other upper and lower guide members 54 and 55 can be automatically and smoothly fitted around the circular column 3 of the already mounted panel unit C. Therefore, there is no need to fit the respective guide members around the circular column 3 or disengage them from the circular column 3 through manual works, and the mounting work becomes easy.

By repeating the above-described operations, a plurality of new panel units C' can be successively mounted from the lower portion of the building body A towards the upper portion.

While the ornamental vertical column was assumed to be a circular column in the above-described two preferred embodiments, it could be a rectangular column 71 having a recessed groove 70 as shown in FIG.

17. In such a modified case, the respective guide members could be formed in such configuration that a pair of guide rollers 73 and an anti-swing roller 74 are provided on a vertical plate 72, and it is only necessary that the pair of guide rollers 73 are made to butt against a side surface 71*a* of the rectangular column 71 and to place the anti-swing roller 74 within the recessed groove 70.

In addition, the guide member support rod 50 could be formed as an integral body, and modification could be made such that a pair of upper guide members 54 and a pair of lower guide members 55 are rotatably mounted to the upper portion and the middle portion, respectively, of the integral body, and a lowermost guide member 56 is fixedly provided at the lower portion thereof to form a guide jig D.

Figure 18:
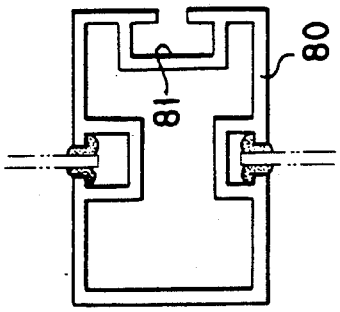
FIG. 18 is a plan view of a mullion.

While description has been made with respect to the case of mounting panel units in the above-described preferred embodiments, the present invention is equally applicable to the case where mullions 80 forming a mullion type curtain wall as shown in FIG. 18 are mounted to a building body A.

In more particular, recessed guide groove 81 is formed in a mullion, and the mullion can be mounted in a similar manner to the above-described second preferred embodiment by placing the above-described anti-swing roller 74 in this recessed guide groove 81 and making the pair of guide rollers 73 butt against one side surface 80*a* of the mullion 80.

Also, while description has been made with respect to the case where wall constituent members are mounted at a corner section in the above-described preferred embodiments, as a matter of course, the present invention is equally applicable to the case where they are mounted at a front section.

Since many changes and modifications can be made to the above-described construction without departing from the spirit of the present invention, it is intended that all matter contained in the above description and illustrated in the accompanying drawings shall be interpreted to be illustrative and not as a limitation to the scope of the invention.

What is claimed is:

1. A method for mounting wall constituent members to a building body, consisting of the steps of forming a guide jig of an upper guide member and a lower guide member, which can vertically move while embracing an outer circumference of a vertical column provided on a front surface of a wall constituent member to serve as a vertical guide section, and a suspending wire connecting said guide members to each other, detachably connecting the upper guide member and the lower guide member of said guide jig to the upper and lower portions, respectively, of a new wall constituent member, making said upper and lower guide members rise while embracing the outer circumference of the vertical column of an already mounted wall constituent member to move the new wall constituent member up to a predetermined position of the building body, mounting the new wall constituent member to the building body, making the upper and lower guide members lower along the vertical column of the new wall constituent member and the vertical column of the already mounted wall constituent member, and then sequentially repeating the aforementioned respective steps, whereby a plurality of new wall constituent members can be mounted sequentially from the lower portion of the building body towards the upper portion thereof.

2. A guide jig for lifting a new wall constituent member comprising an upper guide member composed of a support section that is nearly U-shaped in the horizontal cross-section and provided with a plurality of inwardly facing guide rollers adapted to engage and roll along a guide column, said upper guide member having a mount section that is mounted to the support section and adapted to be connected with a lifting wire to an upper end of the new wall constituent member, a lower guide member composed of a support section that is nearly U-shaped in the horizontal cross-section and is provided with a plurality of inwardly facing guide rollers adapted to engage and roll along said guide column, and a mount section that is mounted to the support section and provided with a fitting piece which can fit to a lower portion of a new wall constituent member in a vertically slidable manner, a length adjusting mechanism connected to the support section of said upper guide member for adjusting the spacing between said upper and said lower guide members, and a suspended wire having one end connected to the support section of said upper guide member via said length adjusting mechanism and the other end connected to the mount section of said lower guide member.

3. A guide jig as claimed in claim 2, wherein said mount section of the lower guide member includes a horizontal member fixedly secured to a base plate of the support section and having a plurality of through-holes drilled therein as spaced form each other in the lengthwise direction thereof, and a fitting piece having a slit groove formed at its bottom so as to slidably fit to the horizontal member from above, and said fitting piece can be fixedly secured to said horizontal member at a desired position by means of a bolt and selected one of said through-holes.

4. A guide jig as claimed in either claim 2 or 3, wherein said length adjusting mechanism is composed of a suspending wire mount piece having an end and being supported from the support section of said upper guide member so as to be rotatable in a vertical plane around an axis of rotation, and locking means for locking said suspending wire mount piece with said end being at two different angular positions of 180° with respect to said axis of rotation, and one end of said suspending wire being connected to said end of said suspending wire mount piece.

* * * * *